US008800219B2

(12) United States Patent
Anderson et al.

(10) Patent No.: US 8,800,219 B2
(45) Date of Patent: Aug. 12, 2014

(54) TILT TOWER ASSEMBLY AND A METHOD OF USING THE SAME, AND A METHOD TO SHIP AND ASSEMBLE A TILT TOWER

(75) Inventors: Charles Anderson, San Angelo, TX (US); Daniel Anderson, San Angelo, TX (US); Grady Roe, San Angelo, TX (US)

(73) Assignee: Wilbur L. Anderson, Inc., San Angelo, TX (US)

( * ) Notice: Subject to any disclaimer, the term of this patent is extended or adjusted under 35 U.S.C. 154(b) by 53 days.

(21) Appl. No.: 13/473,848

(22) Filed: May 17, 2012

(65) Prior Publication Data

US 2012/0291368 A1 Nov. 22, 2012

Related U.S. Application Data

(60) Provisional application No. 61/487,033, filed on May 17, 2011, provisional application No. 61/590,880, filed on Jan. 26, 2012, provisional application No. 61/595,268, filed on Feb. 6, 2012, provisional application No. 61/596,332, filed on Feb. 8, 2012, provisional application No. 61/600,947, filed on Feb. 20, 2012.

(51) Int. Cl.

| | |
|---|---|
| ***E04H 12/34*** | (2006.01) |
| ***H01Q 3/06*** | (2006.01) |
| ***H01Q 1/12*** | (2006.01) |
| ***E04H 12/18*** | (2006.01) |
| ***H01Q 1/24*** | (2006.01) |

(52) U.S. Cl.

CPC ..... *E04H 12/187* (2013.01); *H01Q 3/06* (2013.01); *H01Q 1/1242* (2013.01); *E04H 12/345* (2013.01); *H01Q 1/246* (2013.01); *H01Q 1/1235* (2013.01)

USPC ... 52/117; 52/116; 52/32; 52/114; 52/651.07; 343/881; 343/882

(58) Field of Classification Search

CPC ..... E04H 12/18; E04H 12/187; E04H 12/345; H01Q 1/1235; H01Q 1/124

USPC ..... 52/40, 111, 114, 116, 117, 651.07, 52/745.18, 32; 343/881, 882, 875; 248/121, 156, 295.11

See application file for complete search history.

(56) References Cited

U.S. PATENT DOCUMENTS 1,102,413 A 7/1914 Jensen
2,065,715 A 12/1936 Leon (Continued)

OTHER PUBLICATIONS

Office Action, Canadian IP Office, Candian Application No. 2,777,181; Classification E04H 12/18 (Jan. 2006),; Feb. 4, 2014.

*Primary Examiner* — Robert Canfield
*Assistant Examiner* — Matthew Gitlin
(74) *Attorney, Agent, or Firm* — Jackson Walker, LLP

(57) ABSTRACT

An antenna tower is provided having one or more antennae at the removed end thereof, which tower is configured for ease of maintenance of the antenna by a serviceman standing on the ground and servicing the antenna. Applicants' antenna tower includes a fixed vertical base or mast tube, fixed to the ground and having a removed end. At or near the removed end of the base tube, a swing tube is pivotally attached. The swing tube has a first end removably coupled to a near end of the base tube, and a removed end extending beyond the removed end of the base tube. Attached to the removed end of the swing tube is a pivotally mounted configured member or pivot tube. The pivotally mounted elongated member receives an antenna thereupon. The pivot tube is removably coupled to the swing tube to allow the pivot tube to rotate.

24 Claims, 14 Drawing Sheets

(56) References Cited

U.S. PATENT DOCUMENTS

| | | | | | |
|---|---|---|---|---|---|
| 2,489,720 | A | | 11/1949 | Newell, at al | |
| 2,548,650 | A | | 4/1951 | Brandt | |
| 2,804,950 | A | | 9/1957 | Leslie | |
| 2,812,833 | A | | 11/1957 | O'Nan | |
| 2,822,066 | A | | 2/1958 | Hanson et al. | |
| 2,875,865 | A | | 3/1959 | Rohn | |
| 2,882,080 | A | | 4/1959 | Burns | |
| 3,299,429 | A | | 1/1967 | McMullin | |
| 3,318,560 | A | | 5/1967 | Garrette, Jr. et al. | |
| 3,463,916 | A | * | 8/1969 | Debella | 52/28 |
| 3,525,225 | A | | 8/1970 | Yager at al. | |
| 3,656,170 | A | | 4/1972 | Smith | |
| 3,671,738 | A | | 6/1972 | Beachley | |
| 3,792,680 | A | | 2/1974 | Allen | |
| 3,827,197 | A | | 8/1974 | Adam | |
| 3,875,573 | A | | 4/1975 | Bueckert | |
| 3,941,083 | A | | 3/1976 | Morse et al. | |
| 4,149,347 | A | | 4/1979 | Boemer | |
| 4,167,740 | A | | 9/1979 | Shriver | |
| 4,220,981 | A | * | 9/1980 | Koether | 362/486 |
| 4,473,975 | A | * | 10/1984 | Golay | 52/29 |
| 4,606,155 | A | | 8/1986 | Bukovitz et al. | |
| 4,697,779 | A | | 10/1987 | Guislain | |
| 4,860,021 | A | * | 8/1989 | Kurosawa et al. | 343/840 |
| 5,058,336 | A | | 10/1991 | Jenvey | |
| 5,129,199 | A | * | 7/1992 | Miller et al. | 52/121 |
| 5,448,464 | A | | 9/1995 | Moss | |
| 5,533,304 | A | * | 7/1996 | Noble | 52/40 |
| 5,572,836 | A | | 11/1996 | Parker | |
| 5,613,329 | A | | 3/1997 | Land et al. | |
| 5,782,042 | A | | 7/1998 | Klein | |
| 5,880,701 | A | * | 3/1999 | Bhame et al. | 343/890 |
| 6,232,928 | B1 | * | 5/2001 | Zimmerman et al. | 343/882 |
| 6,647,920 | B2 | | 11/2003 | Lovett | |
| 6,768,474 | B2 | * | 7/2004 | Hunt | 343/892 |
| 6,809,702 | B2 | | 10/2004 | Safakhah | |
| 7,015,872 | B1 | | 3/2006 | Little | |
| 7,089,705 | B1 | * | 8/2006 | Lieberman | 52/146 |
| 7,192,252 | B2 | | 3/2007 | Duguet et al. | |
| 7,377,723 | B2 | | 5/2008 | Nolan | |
| 7,432,875 | B1 | | 10/2008 | Sergi | |
| 8,130,168 | B1 | | 3/2012 | Sergi et al. | |
| 2002/0089466 | A1 | | 7/2002 | Magee et al. | |
| 2002/0149536 | A1 | | 10/2002 | Safakhah | |
| 2004/0027307 | A1 | * | 2/2004 | Hossein | 343/890 |
| 2006/0011789 | A1 | * | 1/2006 | Bergh | 248/156 |
| 2007/0175134 | A1 | | 8/2007 | Christenson | |
| 2011/0099923 | A1 | | 5/2011 | Ventura et al. | |
| 2011/0283640 | A1 | | 11/2011 | Miller | |

* cited by examiner

DETAIL C
DETAIL B
DETAIL A 10
12
12a
12b
13
14
14a
14b
14c
16
16a
16b
16c
18
18a/18b
19
19a
19b
19c
19d
20
20a
20b
22
23
24
32
33
34
35
36
37
A
B
C

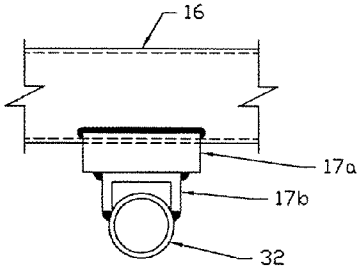
VIEW D-D
(ALL WELDED)
FIGURE 3A
VIEW D-D
(RIGHT VIEW)
FIGURE 3B
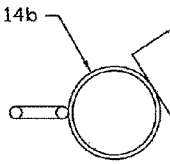
20b PLACEMENT
FIGURE 3C
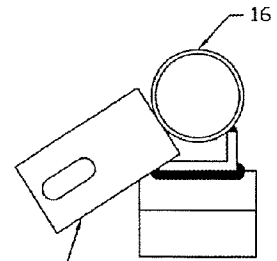
20a PLACEMENT
FIGURE 3D
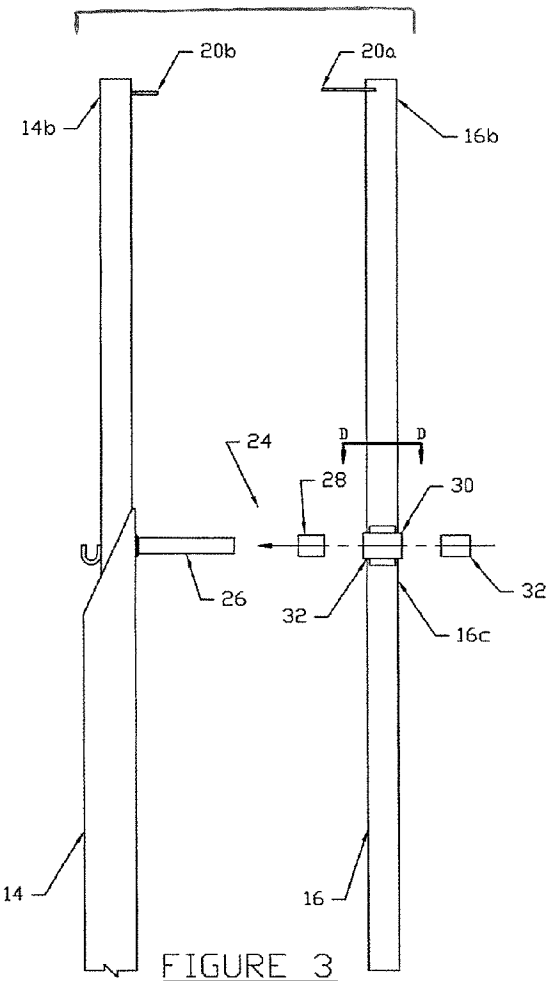
FIGURE 3

TOWER TOP VIEW

TOWER SIDE VIEW

TOWER FRONT VIEW 146
143
144
152
14
38
144b
151
154
147b
148
144e
34
144c
156
147a
144d
150
14b
144a
16a

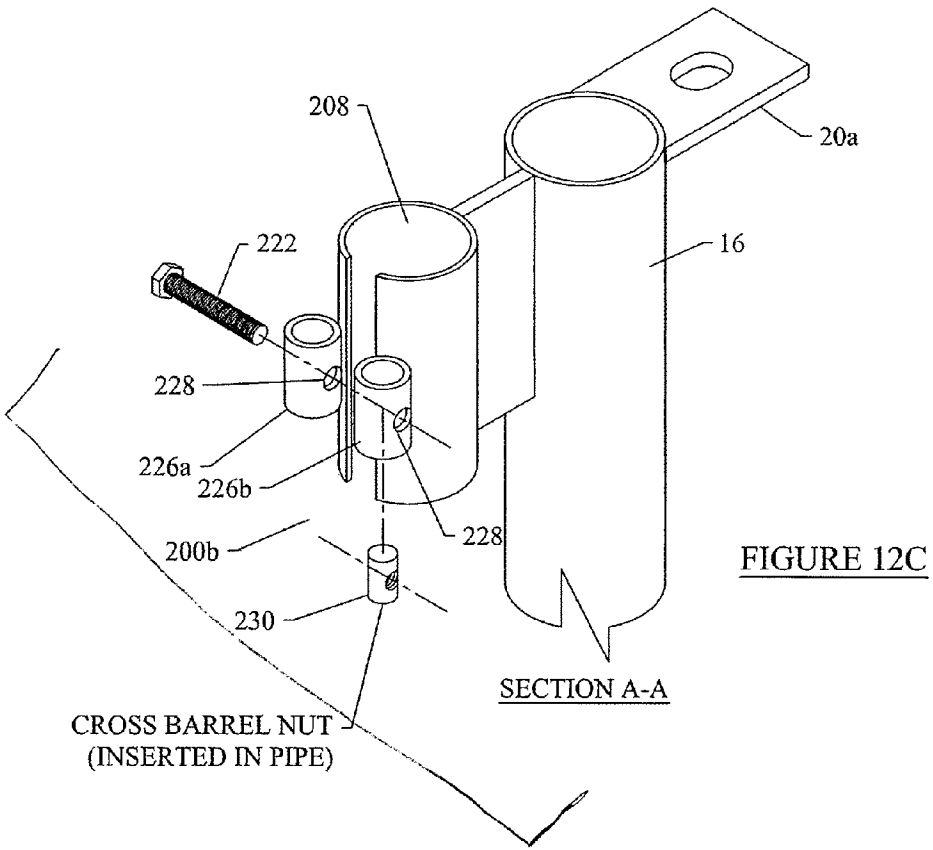
FIGURE 12C
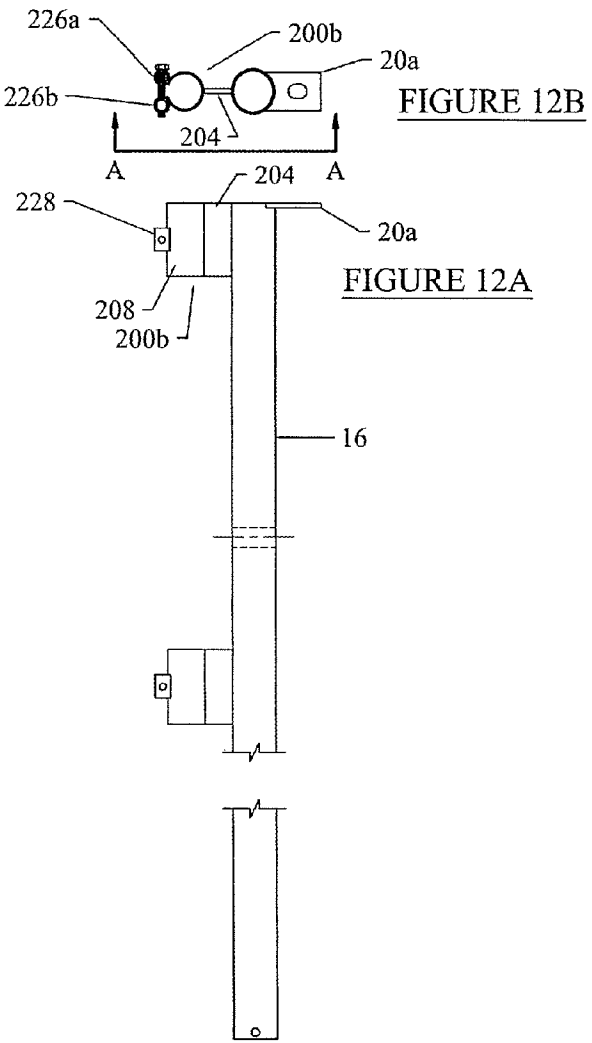
FIGURE 12B
FIGURE 12A

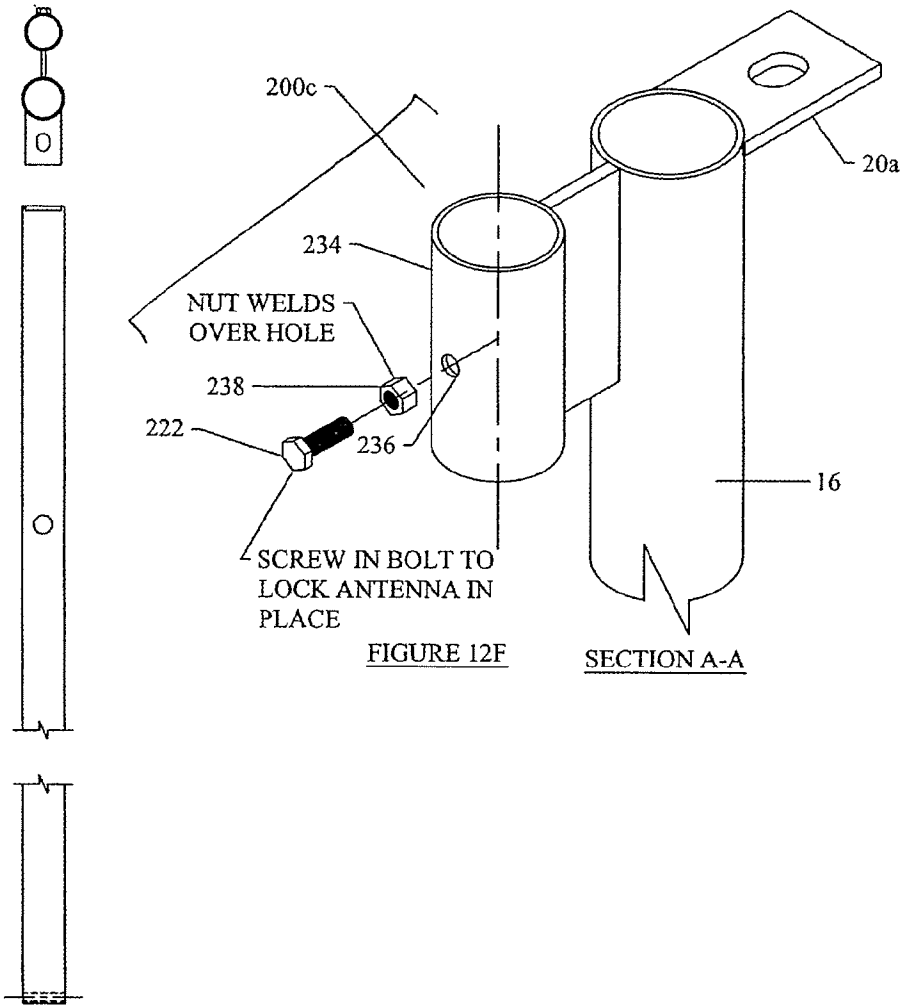
FIGURE 12D
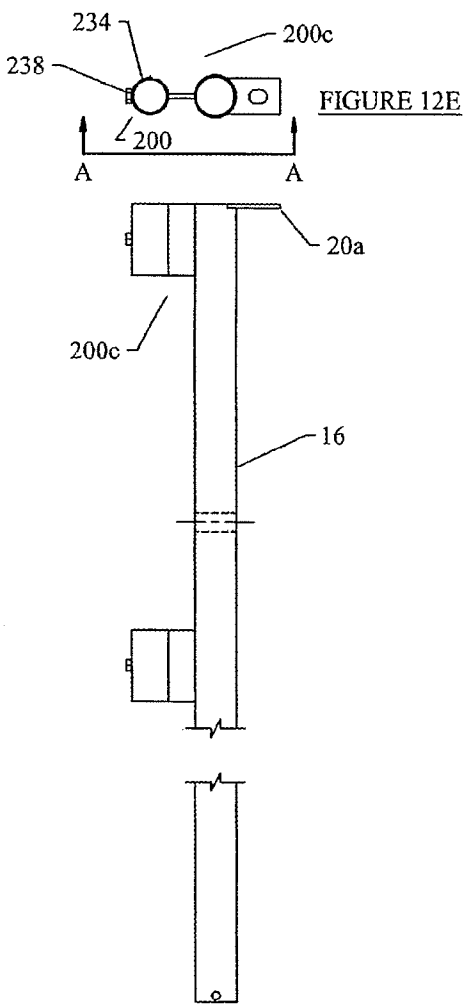

TILT TOWER ASSEMBLY AND A METHOD OF USING THE SAME, AND A METHOD TO SHIP AND ASSEMBLE A TILT TOWER

This is a utility patent application that claims the benefit of, priority from U.S. Provisional Application Ser. No. 61/487,033, filed May 17, 2011; Ser. No. 61/590,880, filed Jan. 26, 2012; Ser. No. 61/595,268, filed Feb. 6, 2012; Ser. No. 61/596,332, filed Feb. 8, 2012; and Ser. No. 61/600,947, filed Feb. 20, 2012.

FIELD OF THE INVENTION

Tilt towers, including tilt towers with pivot members attached to a swing tube thereof.

BACKGROUND OF THE INVENTION

Antennas for receiving and transmitting electromagnetic wave communication are often provided in elevated structures for more efficient receiving and transmitting, such as communication in the 160 mhz to 960 mhz range. As the antennas themselves are mounted typically far off the ground, they are by their position inaccessible. When service or other maintenance is required, some antennas provide for a swing tube mechanism for bringing the removed end of the antenna close to the ground. By this functionality, the antenna itself is able to be reached by the serviceman. Antenna towers of this type are sometimes referred to as "tilt towers."

Antenna tilt towers are known in the art for mounting an antenna to the removed end of a tower. Tilt towers allow a service man access to the antenna by removing a coupling and allowing a tilt or swing tube section of the antenna to rotate about the removed end of the mast or base tube from an antenna up (skyward) position to an antenna down (adjacent the ground providing access to the serviceman) position.

Antennas, themselves, however, typically need to be attached to a mounting member. More specifically, antennas are configured in a number of different ways. That is to say, antenna tower manufacturers may make antenna towers that may be adapted to a number of different antenna configurations (made by antenna manufacturing firms, not tower manufacturing firms), which configurations may attach to a tilting or rotating member of an antenna tower.

Heretofore, the antennas have been attached to the tilt members through a number of differently configured clamps, such as the following: CommScope, Inc. of Hickory, N.C. 28602, Part ## DB5091-3, DB375, DB365-OS, ASPA320, DB375-SP5, ASPR616, ASP617, DB365-SP7, DB365-SP9, DB370. Each of these clips or assembly clamps allows the user to attach one tube or pipe to another tube or pipe. One of the tubes or pipes may be held in a preselected alignment to a second tube or pipe. These clamps typically use multiple members and "all threads" and are sometimes called Andrew/Decibel Antenna Pipe to Pipe and Crossover Clamps.

Often, the single most time consuming procedure during the installation of a PTC Tilt-tower is the installation and alignment of the PTC antenna. Most PTC designs seem to use a clamp originally made by Andrews Corp. The clamp is called an Andrews Clamp and consists of a large number of all-threads, formed steel plate, nuts, and lock washers. The clamp must first be assembled, the antenna mounted, and the antenna aligned. This process may take between forty-five minutes and one hour.

In the prior art, on towers of great length, the Tilt-tube is broken into manageable lengths and connected by a flanges or slip joints. Normally these towers are shipped in three or more separate pieces and include an additional box of hardware.

The coaxial cable, connector fittings, grounding material, and weatherproofing material are shipped separately. All of these pieces are then assembled in the field in all types of weather conditions and field environments.

SUMMARY OF THE INVENTION

Disclosed are multiple embodiments of an antenna tower adapted to or having one or more antennae near the removed end thereof, which will provide ease of maintenance to a serviceman who has to service the antenna attached to the tower and an antenna tower system for ease of assembly, shipping, and erecting. Structurally, these ends are achieved by providing a fixed base tube. At or near the removed end of the base tube, there is a tilt or swing tube pivotally attached. The swing tube may have a length of about twice the base tube. At or near the center of the swing tube is where it pivots about the removed end of the base tube. At the first end of the swing tube and the near end of the base, there is a coupling to uncouple the swing tube from the base, which coupling is typically located within reach of an average adult standing on the ground (about 1 foot to 8 feet). Near the second end of the swing tube is rotatably mounted an articulated antenna mount member, pivot pipe or tube. One or more antennae are typically mounted to the pivot tube on either or both sides of the pivot tube. In alternate embodiments, a configured member may be attached to the pivot tube which is adapted, in turn, to receive an antenna. The pivot pipe or tube is typically, but not necessarily, removably coupled to the removed end of the tilt or swing tube so that it is vertically aligned therewith. Indeed, in normal (non-service) position, the base tube, swing tube, and pivot tube (the pivot tube having the antenna mounted directly or indirectly thereto) form a linear elongated arrangement (see FIG. 1A).

In uncoupling the base tube from the swing tube, the removed end of the swing tube may be rotated such that it is near ground level. A second uncoupling reachable by an average adult standing on the ground will uncouple the pivot tube with respect to the swing tube so as to allow rotation of the pivot tube so that the antenna, mounted thereto, is easily accessible to the serviceman (see FIG. 1C, service position, pivot tube generally parallel to and a few feet above the ground).

In one embodiment of Applicant's device, a tilt tower comprises a fixed, generally perpendicular base tube having a removed end, a swing tube having a removed end and a center portion attached at the center portion pivotally to the removed end of the base tube. A pivot tube is provided for attaching antennae thereto pivotally mounted adjacent the removed end of the swing tube. The swing tube is removably coupled to the base tube. The pivot tube is removably coupled to the removed end of the swing tube, such that, in a coupled position, antennae mounted directly or indirectly to the pivot tube are spaced apart from the ground and in a service or use position with the swing tube rotated with respect to the base tube and the pivot tube rotated with respect to the swing tube, the antennae lay adjacent and close to the ground.

A method is provided for a ground based serviceman to service a tower having an antenna at the removed end thereof. The steps comprise providing a fixed generally perpendicular base tube adapted to engage a ground surface, the base tube having a removed end. A swing tube having a near end and a removed end and a center portion, pivotally attached to the removed end of the base tube. A pivot tube for attaching an antennae thereto is pivotally mounted adjacent the removed end of the swing tube. The swing tube is removably coupled to the base tube. The pivot tube is removably coupled to the removed end of the swing tube. In a coupled position, antennae mounted to the pivot tube are spaced apart from the ground and in an uncoupled service or use position with a swing tube rotated with respect to the base tube and the pivot tube rotated with respect to the swing tube, the antennae lay adjacent the ground. The method may include uncoupling the swing tube from the base; rotating the swing tube about 180° until the pivot tube is accessible to the serviceman; uncoupling the pivot tube from the removed end of the swing tube; rotating the pivot tube so elements of the antenna area accessible to the serviceman; servicing the antenna; and coupling the pivot tube to the swing tube; rotating the swing tube about 180°; and coupling the swing tube to the base. A method may include the step, following the second uncoupling, of locking the pivot tube to the base tube, and before the third rotating step, unlocking the pivot tube from the base tube.

In one embodiment of Applicants' device, a clamp or clip assembly is provided for attaching an antenna having a longitudinal member to a tiltable longitudinal member. A first clip is provide, the first clip having a tabular leg, a resilient gapped cylindrical section with a pair of spaced apart truncated walls (defining an inner space), and a pair of upstanding flat portions. Each flat portion has a first edge for engaging each of the truncated walls as, for example, by welding. A second clip may be provided, the second clip with a tabular leg, a resilient gapped cylindrical section having a pair of spaced apart truncated walls and defining an inner space, and a pair of upstanding flat portions, each flat portion having a first edge for engaging each of the truncated walls. A threadable fastener is dimensioned to engage openings in the two flats. The two clips are aligned and attached to a long mounting member with their gapped cylindrical sections aligned and adapted to receive the cylindrical member of the antenna therethrough.

The "Quick Clip" Antenna Clamp assembly may be constructed of a split pipe with tabs or flats to hold the clamping bolts and cage nuts. A formed steel clamp is utilized. The clamp is attached to a standoff constructed of steel bar and is then typically attached to either the Tilt-tower itself or the Articulated Antenna Mount. The "Quick Clip" Antenna Clamp can accomplish installation of an antenna in about five minutes. The antenna is lined up with the "Quick Clip" Antenna Clamps, slid through the clamps, aligned for proper propagation, and the clamping bolts are tightened into the cage nuts. Installation is complete.

The installation of Positive Train Control and Wayside Control Point Tilt-down or Fold-over towers is extremely time consuming and highly expensive. The standard installation procedure requires the assembly of many parts and accessories in an unfriendly outdoor environment. By Applicants preassembling the tower prior to shipment, field installation takes less time saving countless hours and huge outlays of money. The "Ship-to-Stand" Delivery Process is disclosed by Applicants to accomplish rapid field installation.

The first step in Applicants' assembly and shipping process is to provide a hinge for a two part swing tube, also sometimes called a Tilt-tube. Then, the coaxial cable is premeasured and the connectors, grounds and hoisting grip are installed at exact locations. The pre-fitted coax assembly is installed in the two-part tilt tube and secured. The tower is fully assembled, locked into a folded position, blocked, and strapped with synthetic bands or other suitable material. The towers are loaded onto the trailer and the load is blocked and secured. The "Ship-to-Stand" process saves over 50% of the time and installation cost of a conventional Tilt-down tower fully installed in the field. Applicants' preassembling the tower and pre-installing the accessory material can rapidly achieve the site installation process with a high level of accuracy not attainable during field installation.

BRIEF DESCRIPTION OF THE DRAWINGS

FIG. 1A, Detail A, illustrates details of articulation of pivot assembly wherein the swing tube articulates about the removed end of the base tube.

FIG. 1A, Detail B, illustrates details of articulation of pivot assembly wherein the pivot tube articulates about the removed end of the swing tube.

FIG. 1A, Detail C, illustrates details of the coupling between the removed end of the swing tube and the removed end of the pivot tube.

FIG. 3 illustrates a side elevational view, exploded, of a swing tube/pivot tube pivot assembly.

FIGS. 3A and 3B illustrate section D-D of FIG. 3 in top and side elevation.

FIGS. 3C and 3D illustrate an alternate embodiment of a coupling arrangement between the swing tube and pivot tube.

Figure 5:
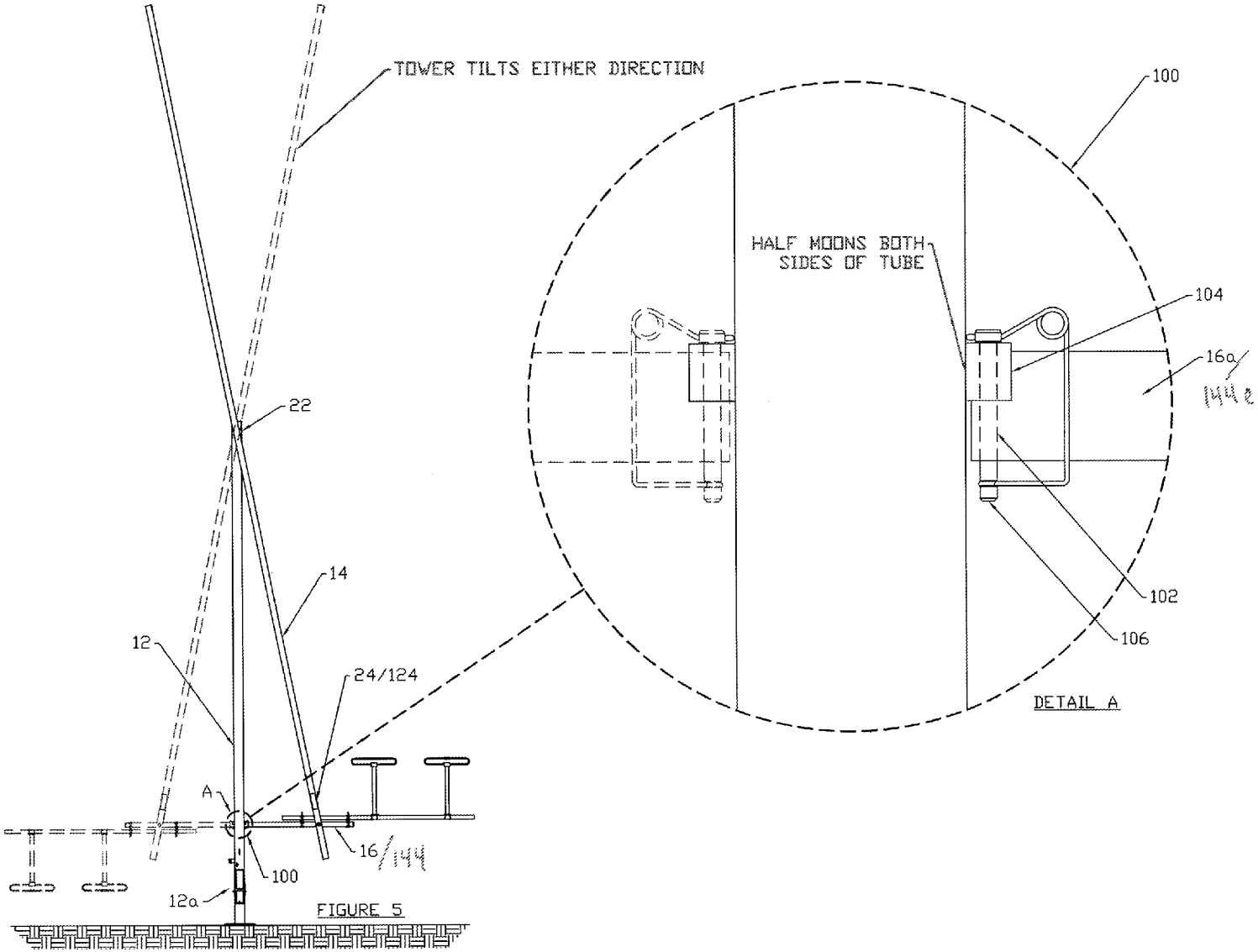
FIG. 5 illustrates a side elevational view of the base/swing/tube pivot pipe in a serviceable locking position.

Detail A of FIG. 5 illustrates a detail of the service position with the swing tube engaging the base through the pivot member by removably locking the pivot member to the base to provide for ease of servicing of the antenna mounted to the pivot tube.

Figure 6A:
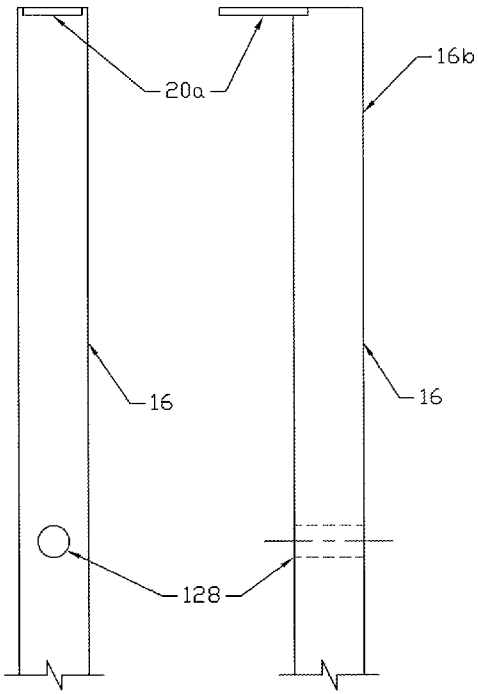
Figure 6B:
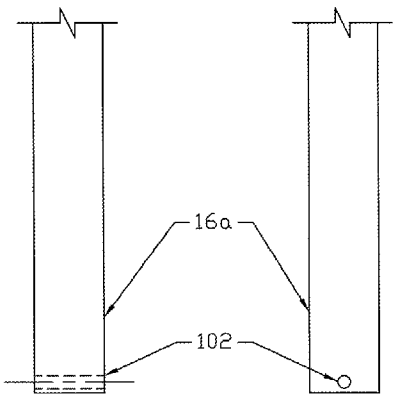

FIGS. 6A and 6B illustrate elements of the pivot assembly arrangement between the articulated antenna mount pivot tube and the removed end of the swing tube and also illustrates structure assisting in the serviceable locking position of FIG. 5 and FIG. 5 Detail A., FIG. 6 being a side elevational view.

Figures 7, 8, 8A:
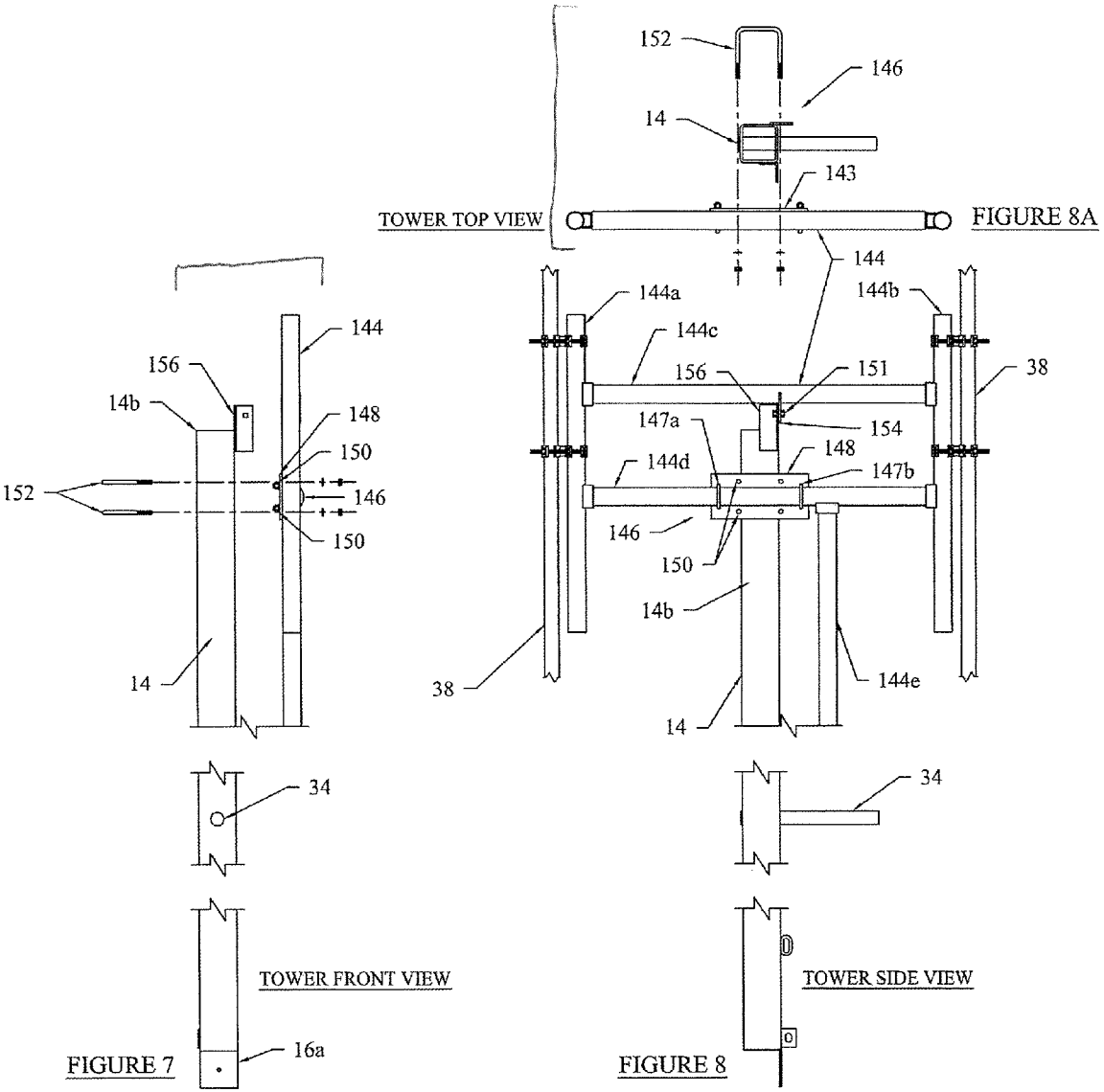

FIG. 7 is a partial front view and FIG. 8 is a partial side view of the tower showing the manner in which an antenna mount member may be engaged to the swing tube.

FIG. 8A is a top view of the antenna mount member of FIGS. 7 and 8.

Figure 9:
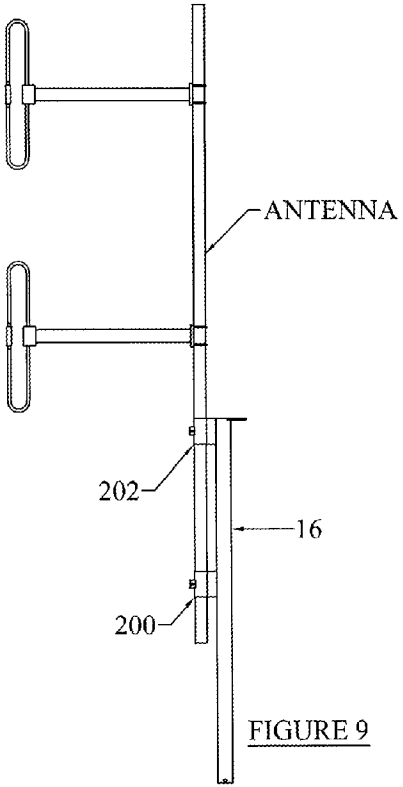

FIG. 9 is a side elevational view of the antenna H-mount pivot member with the clip assembly engaged therewith, which clip assembly in turn holds the antenna coupled to the antenna mount member.

Figure 9A:
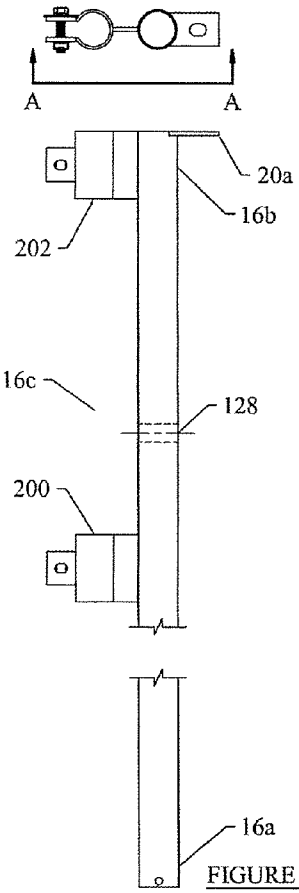

FIG. 9A is a close-up partial view of the pivot member with the clips comprising the clip assembly in side elevational view.

Figure 10A:
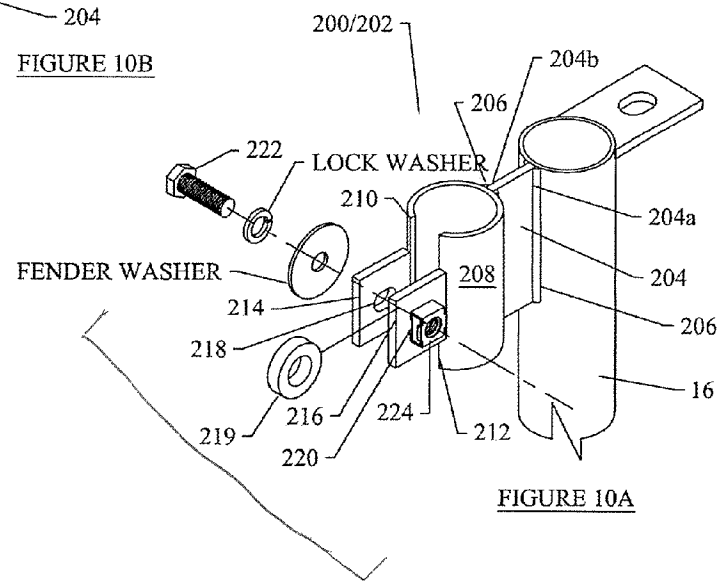
Figure 10B:
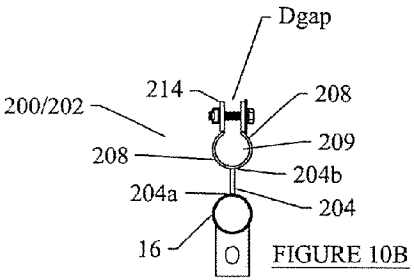

FIGS. 10A and 10B are perspective views and front elevational views, respectively, of the clip assembly engaged with the pivot member.

Figure 11:
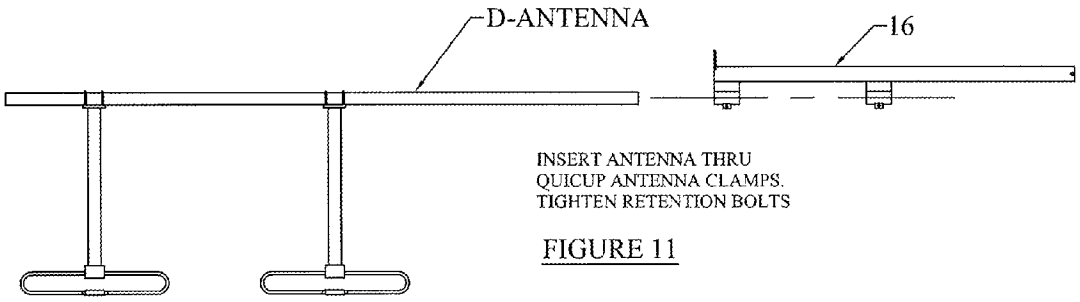

FIG. 11 is a side elevational view of the manner in which the antenna mounts to the clips of Applicant's clip assembly, so as to engage the pivot member.

Figure 12:
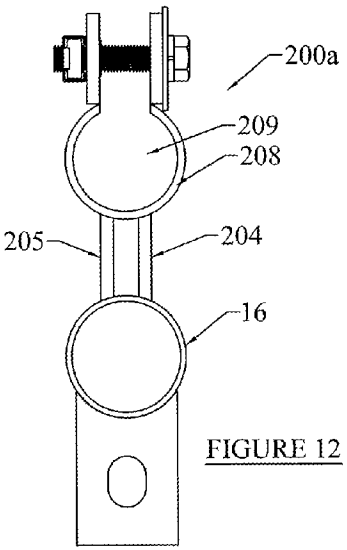

FIG. 12 is a front elevational view of a clip representing an alternate preferred embodiment of Applicant's clip assembly.

FIGS. 12A, 12B, and 12C are side elevational, top, and perspective views of an alternate clip assemblies to engage the antenna to the pivot member.

FIGS. 12D, 12E, and 12F are other alternative preferred embodiments in side elevational, top view, and perspective view of a clip assembly for holding an antenna to a pivot member.

Figure 13:
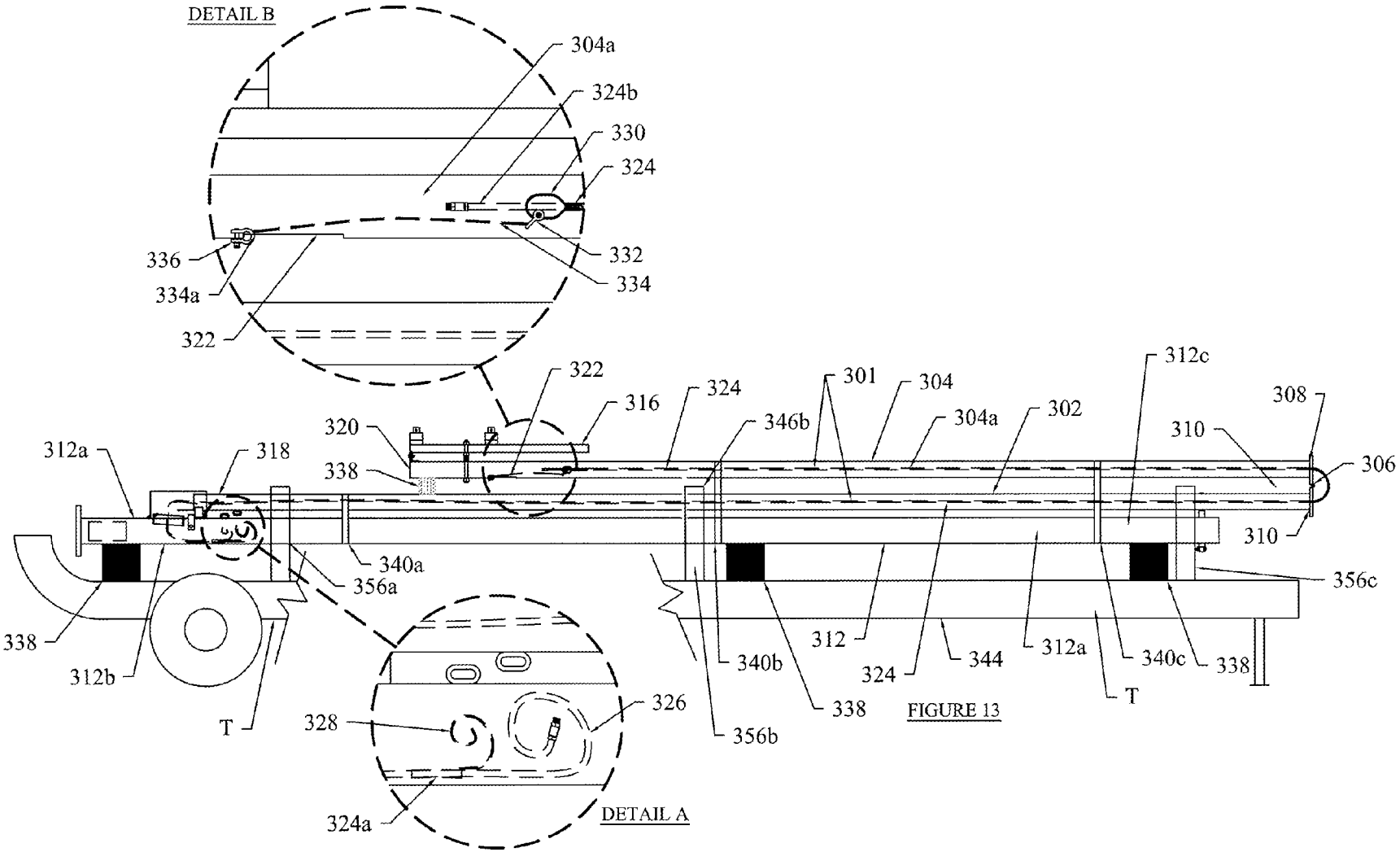

FIG. 13 is a side elevational view of Applicants' Break Down Tower Assembly in a ready to ship condition, loaded on a trailer.

Figure 14:
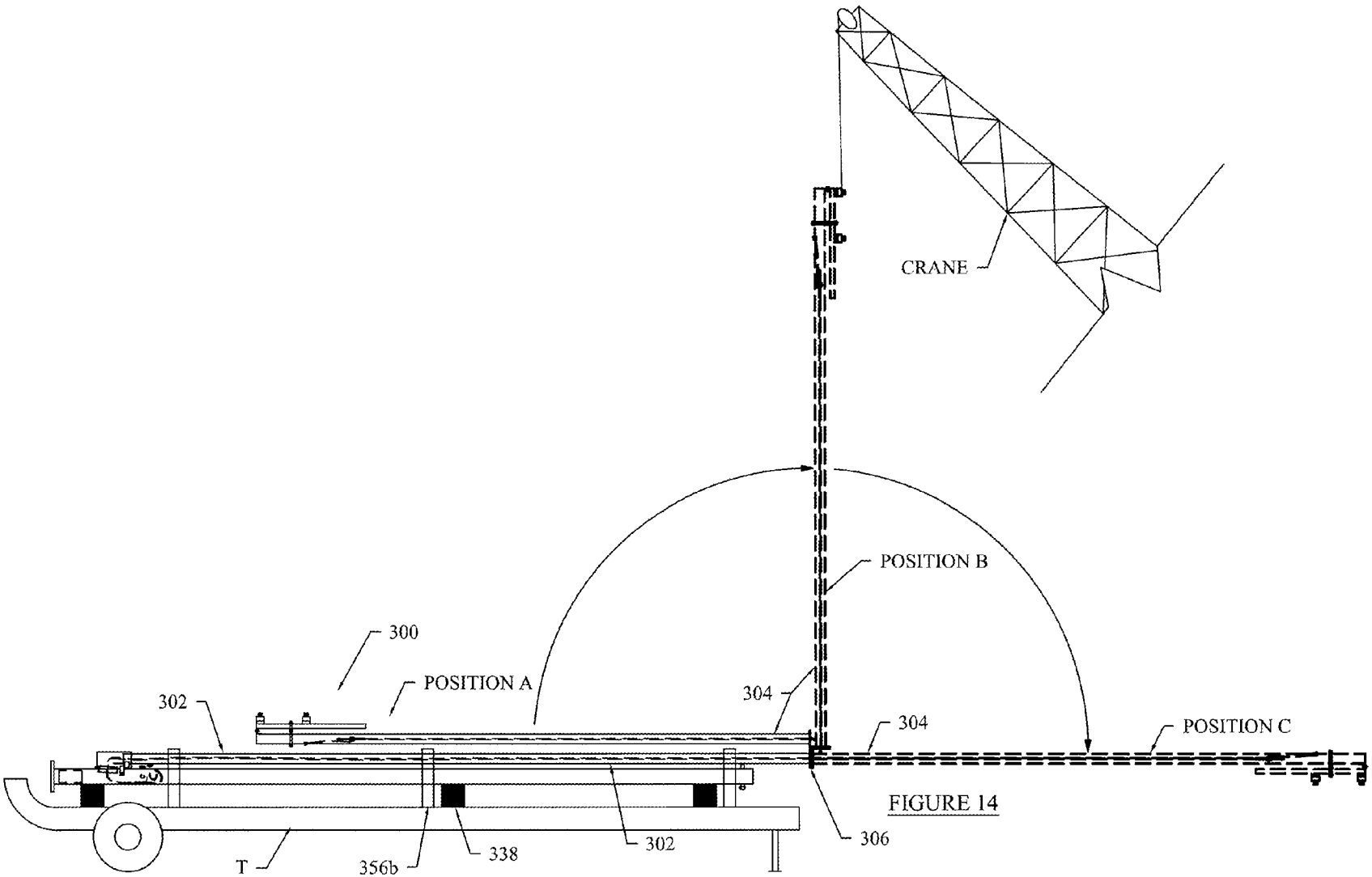

FIG. 14 is a side elevational view of Applicants' Break Down Tower Assembly at an installation location with the hinged swing tube being folded out with the use of a crane.

Figure 15B:
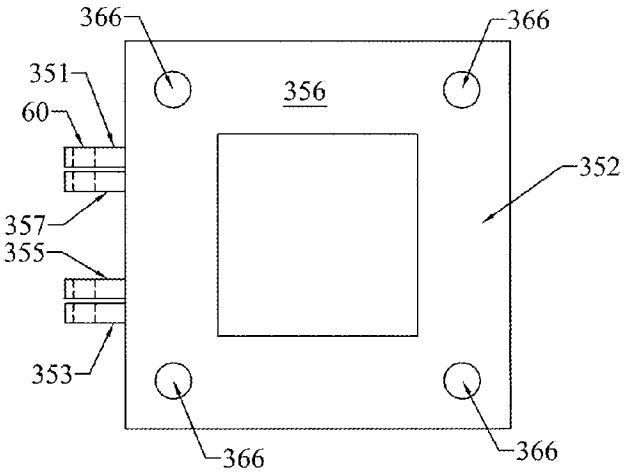
Figure 15A:
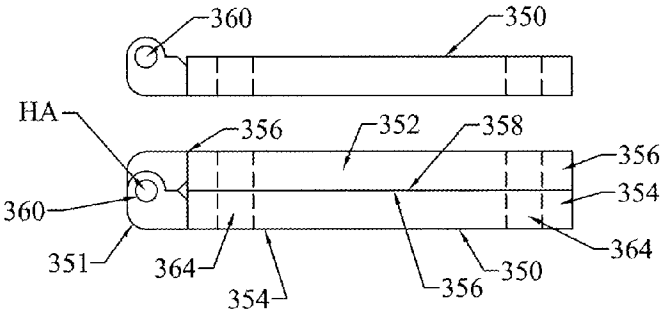
Figure 16:
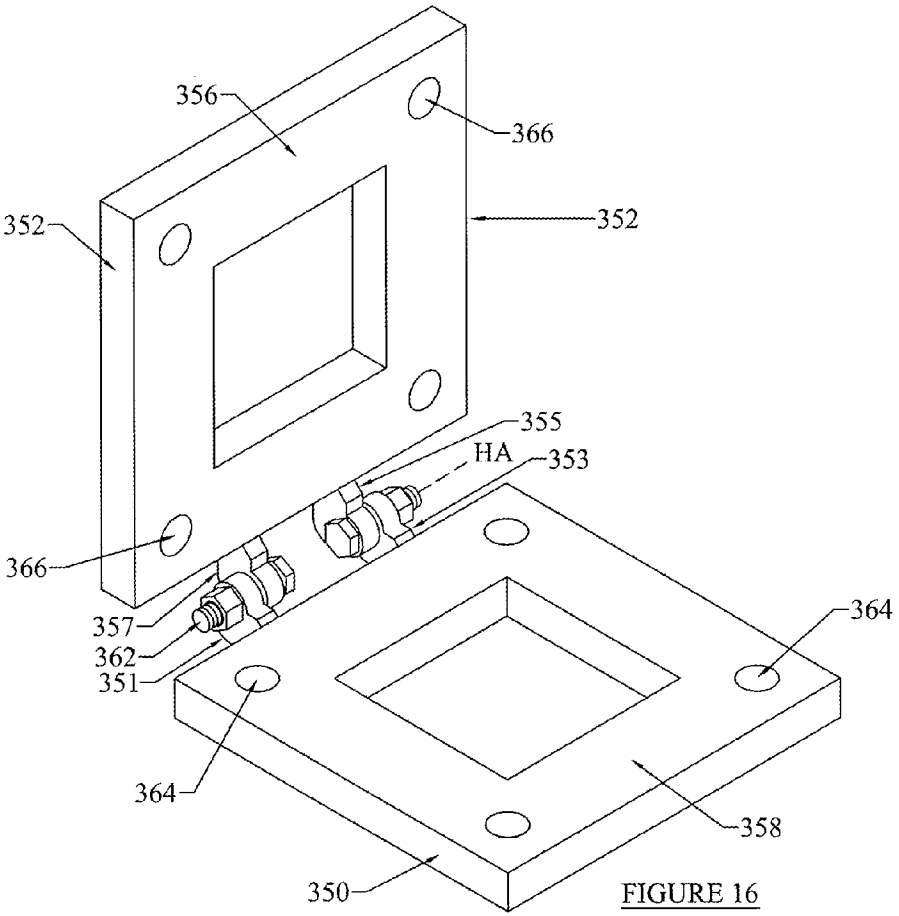

FIGS. 15A, 15B and 16 are multiple views of a hinge for use with Applicants' Break Down Tower Assembly.

DETAILED DESCRIPTION OF THE PREFERRED EMBODIMENTS

Figures 1A, 2:
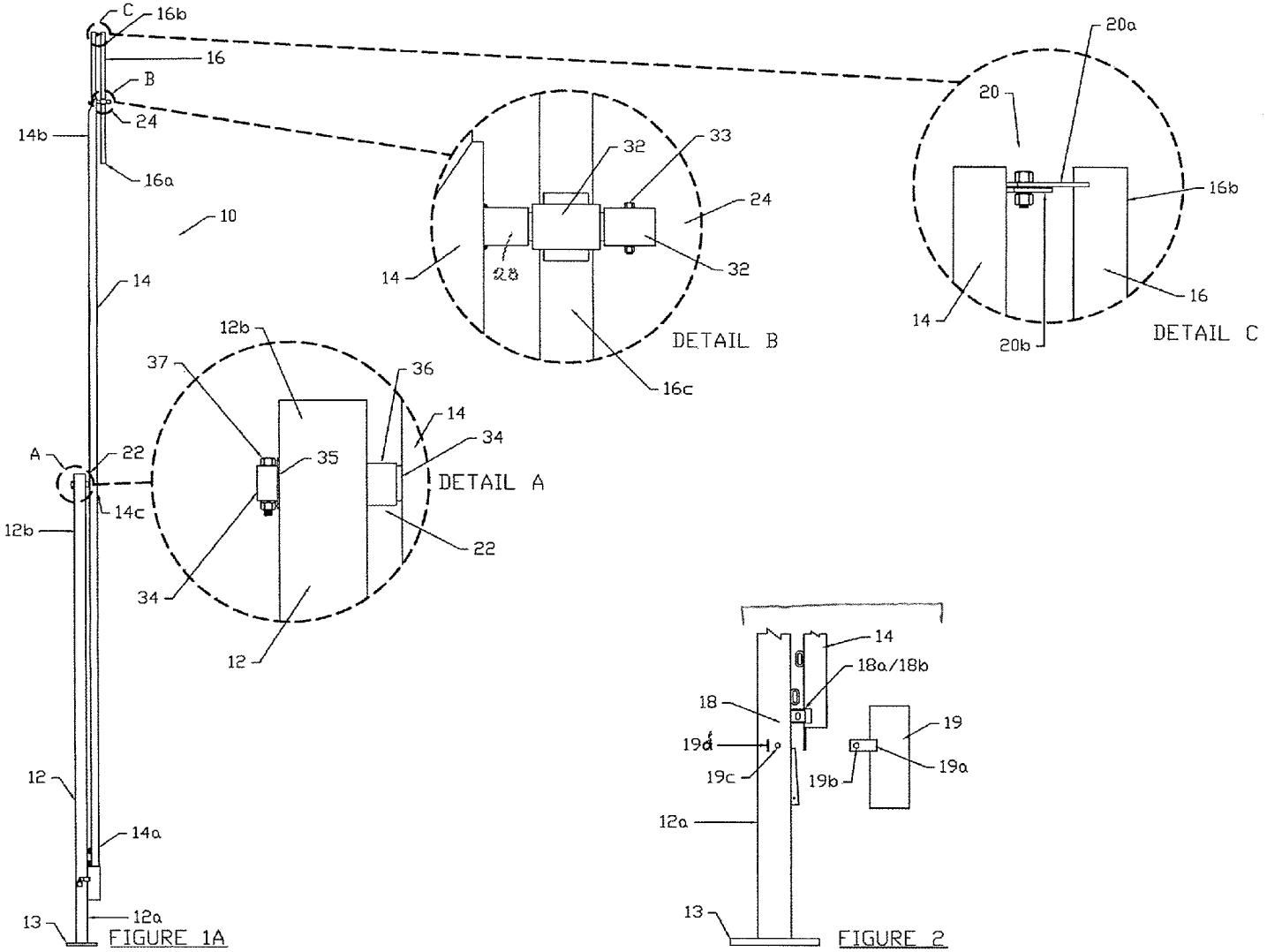
FIG. 1A is a side elevational view of Applicants' tilt tower in a use position, showing the three tubes coupled to one another and vertically aligned.
FIG. 2 illustrates, in side elevational view, details of the coupling between the swing tube to the base tube, and the use of a protective cover.
Figures 1B, 1C:
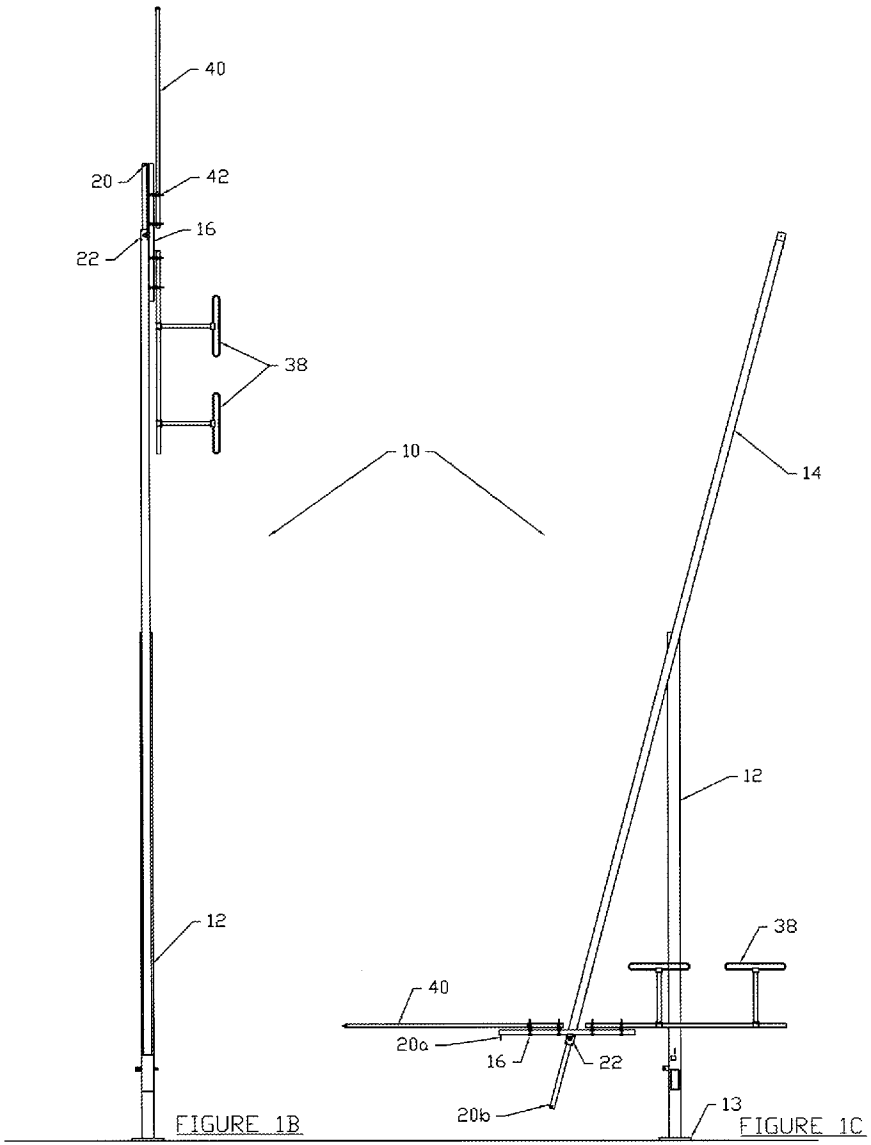
FIG. 1B illustrates the tilt tower in a use position.
FIG. 1C illustrates the tilt tower in a service position.

Applicants provide, as illustrated in FIGS. 1A-C, a tilt tower 10. Tilt tower 10 is capable of assuming a normal elongated position as illustrated in FIG. 1A or a service position as illustrated in FIG. 1C. In FIG. 1A, tilt tower 10 is seen to be comprised of three tubes engaged to one another so they are aligned longitudinally with their longitudinal axes aligned with one another and close to one another. The three elongated members comprise a base tube 12, a tilt or swing tube 14, and an articulating antenna mount or pivot tube 16. Base tube 12 is an elongated member and is attached at near end 12*a* to base plate 13. The base plate is attached to the earth, for example, on concrete pilings or other suitably stable structure. Base tube 12 is seen to have a removed end 12*b* to which is engaged swing tube 14. Swing tube 14 is an elongated member and is seen to have a near end 14*a*, which in the position illustrated in FIG. 1, is close to near end 12*a* of base tube 12. Tilt or swing tube 14 is seen also to have a removed end 14*b* and a center portion 14*c*.

Pivot pipe or articulating antenna mount 16 is seen to have a near end 16*a*, a removed end 16*b*, and a center 16*c*. Swing tube 14 articulates about removed end 12*a* by engagement of the approximate center portion 14*c* of swing tube pivotally with removed end 12*b* of base tube 12. The swing tube/base pivoting action is accomplished to provide access for a serviceman (standing on the ground) to remove end 14*b* of swing tube 14, so as to uncouple the pivot tube or articulating antenna mount from the swing tube. Such uncoupling will allow the pivot tube or articulating antenna mount 16 to assume the generally horizontal position indicated in FIG. 1C. Pivot pipe or articulating antenna mount 16 is pivotally engaged so that it may pivot with respect to removed end 14*b* of swing tube 14.

Turning to FIG. 1A, at the location designated Detail A, articulation assembly 22 is provided for articulating or pivoting swing tube 14 with respect to fixed base tube 12. At the point designated Detail B, articulation assembly 24 is provided for pivotal articulation of pivot pipe or articulating antenna mount 16 near removed end 14*b* of swing tube 14.

To maintain tilt tower 10 with base tube 12, swing tube 14, and pivot pipe 16 longitudinally aligned in its normal position, coupler 18 is provided to couple near end 14*a* of swing tube 14 adjacent near end 12*a* of base 12 as seen in FIG. 2. Coupler 18 may include tabs 18*a*/18*b*, one each rigidly mounted to and projecting from the base and swing tube, which tabs have cooperating matching and aligned openings therein. The openings receive a bolt therethrough, such as a ⅝ inch, 1¾ inch bolt threading through both openings in tabs 18*a*/18*b* to a caged nut to removably secure the two tubes one adjacent the other in a non-moving, normal or use relationship. Cover 19 and elements known in the prior art may securely cover the coupling to prevent unauthorized tampering.

Likewise, to maintain the normal position of tilt tower 10 as illustrated in FIG. 1A, it is helpful to provide coupler assembly 20 for coupling swing tube 14 with respect to pivot pipe or tilt tube 16. Coupler 20 may be seen to include tabs 20*a*/20*b* as seen in FIG. 1A Detail C. The tabs may have ½ inch holes drilled therein. One tab 20*a* is engaged to removed end 16*b* and the other 20*b* to removed end 14*b*. With the holes in the tabs aligned, a bolt, such as ½ inch bolt with a cage nut and washer may be used to engage the aligned tabs. Thus swing tube 14 and pivot pipe 16 may be fixed in a normal position as illustrated in FIG. 1A, Detail C.

FIG. 1A and Detail B illustrate an articulation assembly 24 for allowing the pivot tube 16 to pivot or articulate with respect to the removed end or a portion near the removed end of the swing tube. This pivot point does not have to be at the removed end. As is seen in FIG. 1A, it may be spaced slightly before the removed end 14*b* so as to provide, for example, easy access to coupler assembly 20, removed ends 16*b* and 14*b* adjacent one another.

With reference to FIG. 1A, Detail B, and FIG. 3, pivot assembly 24 is illustrated. Pivot assembly 24 may include an elongated pivot member 26, typically cylindrical, for example, a 7 ⅝ inch long, 1¼ inch steel member, welded so that it is generally perpendicular to the swing tube as indicated in FIG. 3. Spacer 28, such as a 1¼ inch schedule 40 pipe, may be provided to slide over member 26, and to maintain the pivot pipe spaced apart from the swing tube. Spacer 32 may be welded using standoff brackets 17*a*/17*b* to center portion 16*c* of the pivot pipe and has an internal bushing surface that will fit snugly against and ride on the outer surface of member 26. Grease may be applied to this fitting to allow for easy rotation. A second spacer 32 may be provided to receive the removed end of member 26 and a lock bolt, such as a ¼ inch bolt and nut combination, bolt/nut 33 (see Detail B, FIG. 1A) may be provided to engage spacer 32 to the removed end of pivot member 26.

FIGS. 3A and 3B illustrate a pair of rectangular standoff brackets 17*a*/17*b* engaging the pivot tube 16 and sleeve 32, and each other, as by weldment or any other suitable means. FIGS. 3C and 3D illustrate that tabs 10*a*/20*b* may be offset or angled, one to the other.

Similar structure may be seen in FIG. 1A Detail A for pivot assembly 22. Here, however, pivot member 34 is welded to swing tube 14 and projects perpendicular thereto. A spacer 36 may be placed or welded adjacent to the removed 12*b* around a hole in the walls of the base suitable to receive pivot member 34. Holes in side walls of removed end 12*b* will provide a bearing surface on which pivot member 34 may articulate and may receive grease therein. Spacer 35 may be provided to receive the removed end of pivot member 34 therethrough and a bolt 37 may engage the removed end of pivot member 34 and spacer 35 to prevent it from sliding out of removed end 12*b* of the base tube. However, any appropriate pivot means known in the art or coupling means may be provided.

FIG. 1B illustrates Applicants' tilt tower in the use position. Antennae 38/40, such as those, for example, used for PTC (positive train control) are seen to be attached, in this embodiment, to that portion of pivot tube 16 either side of pivot assembly 22. Antennae 38/40 may be attached to pivot tube 16 by any means, including U-bolts 42.

Turning to FIG. 1C, it is seen that, when swing tube 14 is uncoupled and rotated, and when the pivot tube is uncoupled from the swing tube and rotated to a horizontal position, it will assume a position that puts the pivot assembly 22 anywhere from about 1 foot to 8 feet above the ground (or any other suitable height). This will provide easy access to the antennae 38/40 for maintenance or servicing. Moreover, it may also be seen that the removed end of antenna 40 should not extend so far past the coupler 20, that coupler 20 is not accessible to a ground standing serviceman. Antennae 38/40 show just two of the many configurations of antenna that may be mounted to the pivot tube 16 or H-mount 144 (see FIG. 8) directly or indirectly.

The base tube may be 6 inch square tubing or other sized and configured tubing suitable to the size of the tilt tower. The base plate may be 16 inches by 16 inches galvanized steel, 1¼ inch thick. The swing tube may be comprised of 4 inch square ¼ inch wall tubing or any other suitable material. The pivot tube may be comprised of 2 inch, schedule 10, 2⅜ inch OD pipe, 5 ft. 8 in. long or round stock.

FIG. 2 illustrates use of cover 19 with extension 19*a*. Hole 19*b* aligns with hole 19*c* in near end of base tube 12, for receipt of a bar (not shown). Bar may be slid through the aligned holes and a padlock or other suitable lock may lock extension 19*d* to the cover 19 and near end 12*a* to prevent access to tabs 18*a*/18*b*. Other swing tube to base tube couplings are known in the art.

Figure 4:
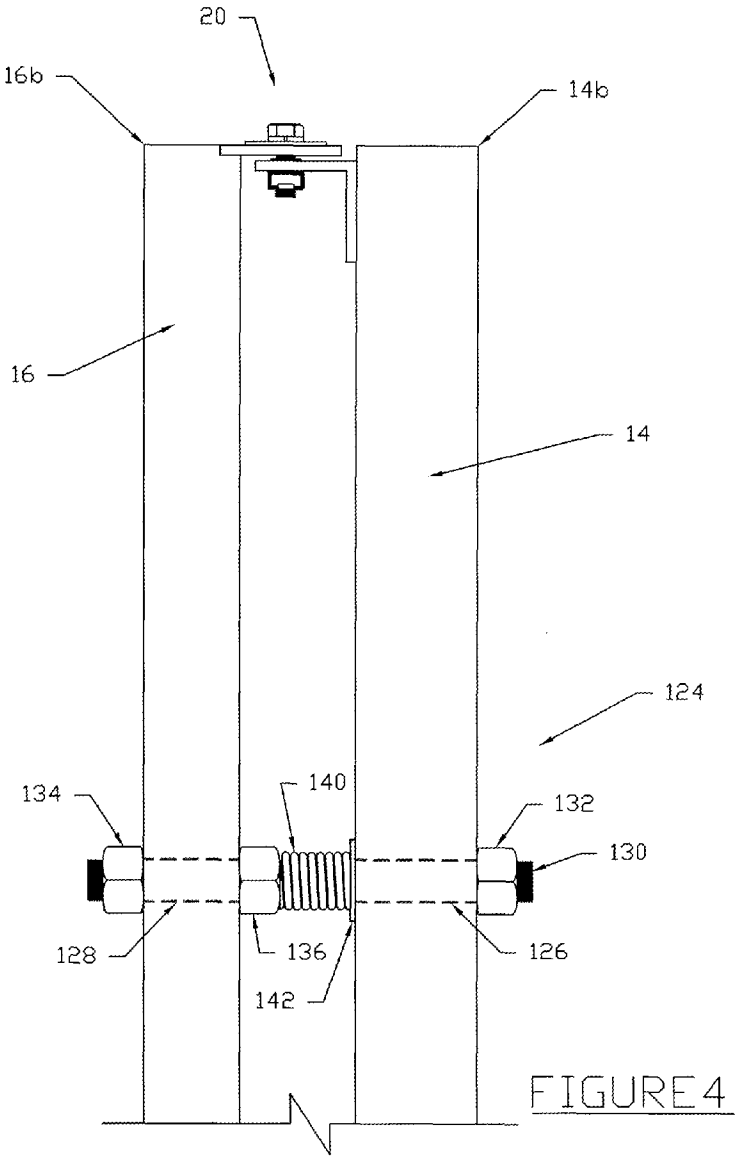
FIG. 4 illustrates an alternate preferred embodiment of a pivot assembly for pivotally engaging the swing tube to the pivot pipe, in side elevational view.

FIG. 4 illustrates a preferred embodiment of pivot assembly 124. The function of pivot assembly 124 is essentially the same as pivot assembly 24 of the earlier embodiment, that is to locate swing tube 14 with respect to pivot tube 16 and provide articulation between the two. However, there are functional advantages achieved from the structure set forth in FIG. 4. FIG. 4 illustrates a swing tube hole 126 and a matching, aligned pivot tube hole 128 adapted to receive an axle 130 therethrough. Axle 130 may be a one inch all thread fastener that is adapted to receive end nuts 132/134 when the axle is entrained through holes 126/128. Moreover, holes 126/128 are typically centered on the side walls side to side. That is to say, if swing tube 14 is constructed of 3"×3" square stock tube, then swing tube hole 126 is 1½ inch on center. Likewise, if the pivot tube is 2⅜ inch OD round stock as illustrated in FIG. 4, then pipe hole 128 is 1³⁄₁₆ inch on center between the two side walls.

A locking nut 136 may be threaded on axle 130 to locate the axle on one of the two members, here on pivot tube 16, which locking has the effect of preventing longitudinal axial movement of axle 130. Coil spring 140 is entrained upon axle 130 and compressed between locating nut 136 and flat washer 142 laying against the tube side wall as illustrated in FIG. 4. Use of the axle/nut/spring combination takes slack out, especially longitudinal slack at the pivot point between the swing tube and the pivot pipe as compared to pivot assembly 24 of FIG. 1A.

Articulated antenna mount pivot tube may be 2 inch O.D. schedule 10 pipe and holes 128/126 of pivot assembly 124 or elements of pivot assembly 24 may be provided in a position that is not centered (that is, offset) between the removed ends 16*a*/16*b* of the pivot pipe. In an alternate preferred embodiment, hole 128 is closer to removed end 16*b* than near end 16*a* so that the pivot pipe will be safely locked at about a 90-degree angle about 4 feet+/−above ground level for servicing the antenna. Pivoting swing tube and/or pivoting pivot tube may be counterweighed so as to pivot in a non-abrupt fashion, counterweight to place appropriate masses at appropriate locations along the lighter ends to counteract unbalanced rotation.

In FIG. 5, Applicants illustrate an antenna mount serviceable locking position assembly 100. Locking position assembly 100 is provided so that once the tilt or swing tube is pivoted from the use position (see FIG. 1A) to the service position (see FIG. 5), it may be removably locked in the down position for ease of servicing by the service technician. The distance above a support surface where this assembly may be located is typically about 1' to about 8' up the base tube. In a preferred embodiment, it is located so the pivot tube is about parallel to the ground when locked on the base tube.

Applicants' locking position assembly 100 is comprised of a locking pin hole 102 fashioned at the near end 16*a* (or removed end) of the pivot tube 16. Near base 12, as seen in FIG. 5 and Detail A in FIG. 5, are seen "half moon" or cup-shaped curved tube seats 104 welded or otherwise fastened to opposite sides of the near end of base 12. Seats 104 are located to place pivot pipe 16 at a working height. Curved seats 104 are configured to receive in a cup-like or nesting manner near end 16*a* (or removed end) of pivot tube 16 or member 144*e* of H-mount 144. The upper apex of curved seat 104 is drilled out to contain a hole 106 dimensioned for receipt of a locking pin therethrough. Indeed, when the swing tube 14 is pivoted for servicing, that is in the position illustrated in FIG. 5, coupler 20 is disengaged to uncouple the pivot tube 16 and the pivot tube is allowed to rotate to a service position illustrated in FIG. 5 and Detail A of FIG. 5, where holes 102/106 are aligned and the locking pin releasably couples the curved seat to the pivotable antenna mount as illustrated (see also FIGS. 6A and 6B). When H-mount 144 is used at the end of swing tube 14, plates 154/156 are uncoupled to allow rotation and engagement to the base tube. Coupling and uncoupling of elements 16/144 to the base tube may also be achieved with tabs, a stout strap to wrap around the adjacent placement of the pivot tube/H-mount to the base tube or any other suitable means.

The base, swing, and pivot tubes may have cutouts at various areas to carry coaxial and other cable elements from the antenna to the base, which cutouts are strategically located to allow for pivoting of the elements of the tower 10.

In FIGS. 7, 8, and 8A, an alternate preferred embodiment is provided, wherein it is seen that antenna 38 may be coupled, not directly to pivot tube 16, but instead to an H-mount configured member 144 which will, in turn hold or engage one or more antenna 38. That is to say, in the arrangement seen in FIGS. 7, 8, and 8A, instead of antenna attaching directly to the pivot tube, there is an indirect engagement through, in this particular embodiment, a member configured as an H-mount to hold the antenna(s) attached to the tower in spaced apart relationship with respect to the longitudinal axis of the pivot tube.

In particular, FIGS. 7, 8, and 8A illustrate H-mount 144 being comprised of two spaced apart uprights 144*a*/144*b* (that is upright when the tower is in a normal, coupled position). Lateral cross-members 144*c*/144*d* are provided and operating arm 144*e* is also provided (see FIG. 8), typically attached to one of the other members of the H-mount, here lower cross-member 144*d*.

The function of the H-mount 144, or other suitably configured interchange member, is to directly or indirectly engage an antenna(s) to the removed end 14*b* of swing tube 14 in a manner that spaces the antenna away from the swing tube and in a manner which may allow more antenna members to be engaged with the tower in pivotal arrangement with the swing tube.

In FIGS. 7, 8, and 8A, it is seen that coupling assembly 146 is provided to couple the H-mount 144 to the swing tube 14. In one embodiment, this may be seen to comprise a plate 148, which may be fastened to any suitable member (typically elongated) of H-mount 144. Here, it is fastened to lower cross-member 144*d* and centrally located thereon. Plate 148 typically includes two pairs of U-bolt receiving holes 150 and a pair of square cross-section U-bolts 152 slipped over removed end 14*b* of swing tube 14 in a manner illustrated in FIGS. 7 and 8. Round section U-bolts 147*a*/147*b* engage a round section cross-member, here 144*d*, tight, but not too tight, such that H-mount 144 may be rotated about 147*a*/147*b* when the swing tube is rotated to a down or service position and fastener 151 is removed from aligned holes of plates 154 (on H-mount cross-member 144*c*) and 156 (on end of swing tube 14*b*). Plate 146 and the related U-bolts hold the H-mount to the swing tube, but allow, when fastener 151 is removed, the rotation of H-mount 144 with respect to the swing tube about the cross-member 144*d* and U-bolt 147*a*/147*b* contact.

Plate 156 may be provided at the top or removed end of swing tube 14 and a correspondingly dimensioned and placed plate 154 may be provided on the H-mount as seen in FIG. 8, which plates each have a hole and for receiving a fastener thereto, ensuring that there is a rigid, but removable, coupling. It is this coupling at plates 154/156 that a serviceman will remove once the swing tube is rotated to provide access to a serviceman located on the ground. After uncoupling plates 154/156, the serviceman may grasp operating arm 144*e* (which will provide a fulcrum to control the movement of H-mount 144). After uncoupling fastener 151 from plates 154/156 and with a hand on the removed end of operating arm 144*e*, the serviceman may allow the rotation of the H-mount 144 to a position generally parallel to the ground for engagement with the half moons 106 as seen in FIG. 5.

It is noted that half moons 106 may be configured to receive square stock if engaging a square stock tube (looking more like an upside down U) or may be half moon, that is, have a generally constant radius of curvature when receiving round stock. In either case, the term "half moon" is used and half moons are typically located to the bottom portion of the base and adapted to snugly receive elements of the pivot tube or, indeed of the antenna or H-mount. That is to say, any form of mating assembly may be provided to engage the tube or elements located thereto with respect rigidly and removably to the lower end of the base tube.

Turning now to FIGS. 9, 9A, 10A, 10B, 11, 12, 12A-12E, it is seen that an antenna mount member or pivot tube 16 may be engaged with an antenna (not shown) using a first clip 200 and at least a second clip 202, the two clips being similarly dimensioned and spaced apart along a longitudinal axis of the antenna mount member or pivot tube 16. The antenna is typically mounted with its longitudinal axis parallel to, but spaced apart slightly, from the antenna mount member or pivot tube 16. The at least two clips 200/202 are typically fastened to the antenna mount member in spaced apart relation one from the other and slideably receive, as seen in FIG. 3, the elongated cylindrical member that is typically found on most antennas, such as the antenna type illustrated in the accompanying Figures.

Antenna mount member, pivot tube 16 is typically also cylindrical in cross-section and may have a removed end 16*b* and a near end 16*a*, the removed end 16*b* including a tab 20*a* or other attachment means to engage it with a tilt member. A pivot hole 128 may be located along the longitudinal axis of the antenna mount member 16, here, in a generally centrally located portion 16*c*. Pivot hole 128 may receive a cylindrical member or axle to rotate or pivot as set forth hereinabove. In any case, the antenna mount member or pivot tube 16 is typically cylindrical and elongated, and the antenna typically has a cylindrical and elongated member engaged therewith.

Antenna mount member or pivot tube 16 is seen to have a first clip 200 and a second clip 202 in spaced apart relation, but longitudinally aligned so as to receive the antenna as set forth in more detail below.

As seen in FIGS. 10A and 10B, in FIG. 10B, for example, first clip 200 and second clip 202 are similarly dimensioned. First clip 200 is illustrated in the Figures with the understanding that both clips are similarly dimensioned and have similar major parts.

First clip 200 is seen to include a depending leg 204, which may be tabular and engage at a weldment 206, to the outer surface of the antenna mount member. Indeed, leg 204 may be tabular in nature with the long side 204, as illustrated in the Figures, attached so that it is parallel to the longitudinal axis of the antenna mount member 16.

Opposite edge 204*a* is edge 204*b* attached, by weldments 206 or other suitable means, to a gapped generally cylindrical section 208, which define an interior space 209. Truncated walls 210/212 define removed ends of gapped cylindrical section 208 and define the gap "Dgap" therebetween. Gapped cylindrical section 208 is dimensioned to receive a straight, elongated cylindrical portion of the antenna therethrough. Truncated walls 210/212 have upstanding first and second tabular flats 214/216, which extend upwards, typically in a plane parallel to the plane of leg 204. Further, it is seen that flats 214/216 are tabular in nature and may have openings 218/220 or slots therein. Openings 218/220 are dimensioned to receive a fastener 222/224 (bolt and nut combination) therethrough, which fastener has a shaft long enough to bridge the gap Dgap. Washer or seal 219 is dimensioned to allow some compression of gapped, cylindrical section 208 against the antenna member by compression of flats 214/216, but not too much to allow deformation.

The diameter of gap cylindrical section 208 is typically equal to or preferably slightly greater than the diameter of the elongated section of the antenna DiaAnt that it is designed to receive, with the fastener loosened therein. After the cylindrical section of the antenna is entrained in the at least two clips 200/202, the fastener may be entrained upon the first and second openings 218/220 and threaded down to close the gap until the inner walls defining gap cylindrical section 208 are snugly and tightly upped against the outer surface of the longitudinal section of the antenna.

Clips 200/202 are comprised of a resilient material, such as mild steel. The dimensions set forth on the two sheets are nominal and dimensions may be made larger or smaller as necessary.

FIG. 12 is an alternate preferred embodiment of the clip, here, designated clip 200*a*. Alternate clip 200*a* has, instead of a single leg 204, a pair of legs 204/205 spaced apart slightly as seen in FIG. 12. Weldments may be used to maintain both legs 204/205 to the antenna mount member and the gapped cylindrical section 208. Since there is sufficient resiliency in the metal defining the truncated cylindrical walls 208, the gap may be spread sufficiently wide and the antenna member slipped through inner space 209, such that the pair of legs still provide for sufficient clasping of the antenna.

Although Applicant's clip assembly is shown with an embodiment of a tilt tower that includes a second tilting member near the removed end thereof, pivot tube 16 herein, an embodiment of Applicant's clip assembly may be used with any straight member capable of mounting an elongated member thereto.

In FIGS. 12A, 12B, and 12C, three views of a second alternate embodiment 200*b* of Applicant's clip for engaging an antenna mount to a pivot tube 16 is disclosed. As in the previous embodiments, two or more clips 200*b* may be used (illustrated in FIG. 12A). This embodiment 200*b* is similar to those above to the extent that it includes leg or legs 204 and gapped cylindrical section 208. However, in place of first/second element 214/216 as seen in FIG. 12A, cylindrical elements 226*a*/226*b* are used. Cylindrical elements 226*a* and 226*b* have holes 228 adapted to receive a fastener 222 therethrough. At least one of the two cylindrical elements may be adapted to receive a cross-barrel nut 230 threaded for receipt of fastener 222 therein. Tightening or loosening the clip is achieved by rotating fastener 222, cross-barrel nut 230 being "captured" within cylindrical element 226*b*.

FIGS. 12D, 12E, and 12F illustrate yet another alternate embodiment of Applicant's clip 200*c*. In this embodiment, it is seen that a closed cylinder 234 slightly larger than the cylindrical member of the antenna that pivot tube 16 is adapted to receive is presented. Cylindrical element 234 has a hole 236 in the exterior walls thereof to which a nut 238 is attached adjacent thereto. A fastener 222 is received in the nut and screwed into the hole and presses against the outer walls of the antenna member (not shown) that is at least partially within tube 234. Nut 238 may attach to cylinder 234 by any suitable means, for example, by a weldment.

Applicants disclose a Break Down Tilt Tower Assembly 300 in FIGS. 13, 14, 15A and B and 16 which is configured at a manufacturing location to be able to ship and install the tilt tower 10 at a remote site location. Time is saved using a Tilt Tower Assembly 300 having the unique features as set forth herein and using the steps disclosed for shipping and installing the tilt tower.

Turning first to the novel Break Down Tilt Tower Assembly 300 in a folded, ready to ship condition, in FIG. 13 it is seen that swing or tilt tube 301 (see FIG. 14) is comprised of at least 2 sections (here two sections), first section 302 and second section 304 that are hinged together with hinge 306. In one embodiment, hinge 306 is configured as set forth herein to allow section 304 to lay parallel and adjacent to section 302 in a folded or shipping position A as set forth in FIG. 13 and to fold out to an unfolded position C as seen in FIG. 14. The unfolded, position C allows the installation of the tower at the tower installation site, but the folded, position A allows for easy packing and transportation from the factory to the installation site.

Turning back to FIG. 13, it is further seen that a coax or conductor assembly 324 is provided, having a near end 324*a* and a removed end 324*b*. Conductor assembly 324 is comprised of at least a coaxial cable 326 and a ground 328, both typically attached and the assembly substantially enclosed within interior 302*a* of first section 302 and interior 304*a* of second section 304. Prior to shipping and installation, conductor assembly 324 is cut to proper length as known for prior art PCT antenna assemblies. A hoisting grip 330, configured to receive a hand or fingers, is attached at or near the removed end of the assembly, see detail B, FIG. 13. Further, pull rope 334 is provided, typically attached to hoisting grip 330 or other suitable location at or near removed end 324*b*. Here a clevis 332 is used to tie off pull rope 334 to hoisting grip 330. Removed end 334*a* of the pull rope is tied off at clevis 336. Clevis 336 is seen attached to walls adjacent coax access slot 322 near removed end 320 of second section 304 of the tilt tower.

The added pull rope 334 is typically dimensioned to a length sufficient to allow the user to pull the removed end 324*b* up to access slot 322 to allow the coax assembly to engage the antenna in ways known in the art. Removed end 324*b* can be tied to clevis 336 typically after fold out of swing tube to position C as seen in FIG. 14.

Turning to FIGS. 13 and 14, it is seen that tilt tube first section 302 has near end 318 which is configured as a normal tilt tube and is removably engageable to a near end 312*b* of normally configured base tube 312. Base tube 312 has an interior 312*a* for receiving part of the conductor assembly 324. Removed end 312*c* of base rotatably engages first section 302 near hinged end 310 thereof, beyond which hinge 306 attaches to hinged end 310. Hinge 306 also attaches to hinged end 308 of second section 304.

As seen in FIGS. 15A, 15B, and 16, Hinge 306 is comprised of plates 350 and 352. Plates 350 and 352 are similarly configured, FIG. 15B showing plate 352 having facing side 356 and FIG. 16 showing plate 350 having facing side 358, the facing sides 356/358 laying generally flush to one another when the Assembly is in a use or unfolded position as seen in FIG. 15A and position C in FIG. 14.

Hinge plates 350/352 are configured to rigidly engage the hinged ends 308/310 by weldment or other suitable means on the walls opposite each of the facing sides 356/358. Plate 352 has ears 355/357 configured to fit adjacent ears 351/353 of plate 350 as seen in FIG. 16. All ears 351/353/355/357 have a hole 60 that will align when the facing sides 356/358 are against one another and will receive a fastener 362 or other hinge pin so as to pivotally engage the two sections 302/304. FIG. 15 illustrates holes 60 aligned for receipt of fastener 362 therein, FIG. 16 illustrates fastener 326 entrained in holes 60.

Holes 60 are seen to define a hinge axis HA which is in the plane of and adjacent to hinge facing sides 356/358 as best seen in FIG. 15A. A perimeter area 354/356 (outside of weldment) is seen on each plate 350/352 to contain typically four holes 364 in plate 350, and typically four holes 366 in plate 352 which holes 364/366 are aligned for receipt of four fasteners 368 (one shown in FIG. 15*a*) when holes 364/366 are aligned when the assembly 300 is in the unfolded position C as indicated in FIG. 14.

In the folded position, or position A as seen in FIG. 13, any number of assembly securement straps 340*a/b/c* may engage base tube and/or sections 302/304 to maintain the assembly in position A. One or more load securement straps 356*a/b/c* may be used to hold assembly to the bed of a trailer T as seen in FIG. 13. Any number of straps alone or in combination may be used to hold the assembly in the folded position and to the trailer (or a truck bed or other suitable transportation device). Blocks 338 (wood or other suitable material) may be used to separate elements from one another and from the trailer for shipment.

At the installation site, as seen in FIG. 14, a crane may be used to engage section 304 and lift it into position C, crane seen in FIG. 14 with section 304 in an intermediate position B. Fold out may be accomplished with assembly 300 still on the trailer, with at least some load securement straps holding all but section 304 to the Trailer, or may be done with the assembly on the ground. Once section 304 is unfolded and secured to section 302 with fasteners 368, the tower may be erected in ways known in the art, typically with the crane lifting the mast and straight (coupled) swing tube and pivot members (coupled). The tower is then attached to a foundation in ways known in the art. The unique folding swing tube may be used with or without the pivot member or other features set forth herein or known in the art.

| TOWER ASSEMBLY | 20' Height | 40' Height | 60' Height |
|---|---|---|---|
| 1. Length O/A (installed) (Some suitable dimensions are set forth herein, measured from near end of base tube to far end of pivot tube.) | 20' +/− 1' | 40' +/− 1' | 60' +/− 1' |
| 2. Mast or base tube length (pivot typically located about 1' from removed end) | 11' +/− 1' | 21' 1" +/− 1' | 30' 6" +/− 1' |
| 3. Swing tube length (pivoted at or near center and may have a counterweight if antennas are heavy) | 19' 6" +/− 1' | 34' 3" +/− 1' | 54' 1" +/− 1' |
| 4. Pivot tube length (could be any length depending on antenna weight/load) | 4'-10' +/− 3' | 4'-10' +/− 3' | 4'-10" +/− 3' |

While the term "tube" or "pipe" is used, it is intended to cover round, square or any other suitable cross-sectional configurations. Pivot member is intended to include pivot tube, H-mount or any other member configured to hold an antenna as well as to releasably, pivotally engage a removed end of the swing tube.

Western Towers' tilt towers may be used in a variety of communication situations. Towers for the Positive Train Control program being one such situation. However, Western Towers' tilt towers may be used by a variety of consumer applications, including, but not limited to, petroleum industry applications, weather reporting applications, solar panel installations, and other applications that require wireless radio communications.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A tilt tower comprising:

a fixed generally perpendicular base tube having a near end and a removed end, the near end adapted to engage a support surface;

a swing tube having a first and second end and a center portion, the swing tube rotatably attached at the center portion to the removed end of the base tube;

a pivot member, the pivot member engaged to the second end of the swing tube and adapted to rotate with respect to the swing tube, the pivot member with walls for engaging an antenna;

a first coupling assembly for coupling and uncoupling the first end of the swing tube to the near end of the base tube, such that when coupled the swing tube is generally parallel to the base tube; and a second coupling assembly for coupling and uncoupling the pivot member from the swing tube further including a third coupling assembly adapted to couple and uncouple the pivot member to the base tube when the swing tube is uncoupled from the base tube and when the pivot member is uncoupled from the swing tube; and wherein the third coupling assembly includes an elongated member and wherein the base tube includes a plate with a hole therethrough, and wherein the pivot member includes a hole, the third coupling assembly configured to align the hole in the pivot member with the hole in the plate on the base tube for removable receipt of the elongated member therethrough.

2. The tilt tower of claim 1, further including a first axle for pivotally engaging the swing tube to the base tube.

3. The tilt tower of claim 2, further including a second axle for pivotally engaging the pivot member to the swing tube.

4. The tilt tower of claim 3, wherein the second axle includes a spring entrained thereupon, the axle including locating members at removed ends thereof; wherein the swing tube and the pivot member are maintained in spaced apart relation by the spring.

5. The tilt tower of claim 1, wherein the second coupling assembly maintains the pivot member in a generally parallel arrangement with respect to the swing tube when the second coupling couples the pivot member to the swing tube.

6. The tilt tower of claim 1, wherein the second coupling assembly includes members engaging both the swing tube and the pivot member, configured to be in an aligned position when coupled and an out of alignment position when uncoupled.

7. The tilt tower of claim 6, wherein the members are two, one located at the first end of the pivot member and the other at the first end of the swing tube.

8. The tilt tower of claim 1, wherein the pivot member is substantially a single linear member.

9. The tilt tower of claim 1, wherein the pivot member further includes at least one upright and at least one cross-member.

10. The tilt tower of claim 1, wherein the pivot member includes an antenna engagement clamp.

11. The tilt tower of claim 10, wherein the pivot member includes an antenna.

12. The tilt tower of claim 10, wherein the antenna engagement clamp includes at least a pair of gapped cylindrical sections.

13. The tilt tower of claim 1, wherein the pivot member comprises an "H"-mount member.

14. The tilt tower of claim 1, wherein the swing tube and base tube are substantially hollow and further including a coaxial assembly at least partially enclosed in each of the tubes.

15. The tilt tower of claim 1, further comprising a counterweight near the first end of the swing tube configured to offset the weight of the pivot member and any antenna thereon.

16. The tilt tower of claim 1, wherein the swing tube includes a hinge located between the first and second ends, the hinge defining at least a first hinged section of the swing tube and a second hinged section of the swing tube, the hinge configured to place the two hinged sections in substantially parallel alignment one adjacent each other when the swing tube is in a folded, ready to ship, position.

17. The tilt tower of claim 16, wherein the hinge includes a first plate engaged to the first hinged section and a second plate attached to the second hinged section, wherein the hinge further includes a hinge pin pivotally engaging the two plates.

18. The tilt tower of claim 17, wherein each of the two plates includes a set of fastener holes which may be aligned for receipt of fasteners therein, such that when the holes are aligned, the two swing tube hinged sections are in an unfolded position that places them in alignment such that they define a generally straight member.

19. The tilt tower of claim 17, wherein each of the plates includes cutouts and a perimeter portion, the cutouts for allowing passage of a coaxial assembly therethrough.

20. The tilt tower of claim 16, wherein the swing tube and base tube are substantially hollow and further including a coaxial assembly at least partially enclosed in each of the tubes and wherein the hinge configured to allow the coaxial assembly to pass therethrough.

21. The tilt tower of claim 20, wherein the coaxial assembly includes a hoisting grip.

22. The tilt tower of claim 21, wherein the coaxial assembly further includes a pull rope.

23. The tilt tower of claim 16, wherein the hinge is located closer to the second end of the swing tube than to the first end of the swing tube and wherein the swing tube is pivotally attached to the base at a point closer to the first end of the swing tube than the hinge.

24. The tilt tower of claim 1, wherein the swing tube is an unbroken member.

* * * * *